US008967959B2

(12) United States Patent
Stein et al.

(10) Patent No.: US 8,967,959 B2
(45) Date of Patent: Mar. 3, 2015

(54) TURBINE OF A TURBOMACHINE

(75) Inventors: Alexander Stein, Simpsonville, SC (US); Thomas James Brunt, Mauldin, SC (US)

(73) Assignee: General Electric Company, Schenectady, NY (US)

( * ) Notice: Subject to any disclaimer, the term of this patent is extended or adjusted under 35 U.S.C. 154(b) by 796 days.

(21) Appl. No.: 13/284,150

(22) Filed: Oct. 28, 2011

(65) Prior Publication Data

US 2013/0104566 A1 May 2, 2013

(51) Int. Cl.
*F01D 9/02* (2006.01)
*F01D 9/04* (2006.01)
*F01D 5/14* (2006.01)

(52) U.S. Cl.
CPC ..... *F01D 9/041* (2013.01); *F01D 5/141* (2013.01); *F01D 5/142* (2013.01)
USPC ..... 415/192; 415/210.1

(58) Field of Classification Search
USPC ..... 415/191, 192, 208.1, 208.2, 209.2, 415/209.3, 209.4, 210.1
See application file for complete search history.

(56) References Cited

U.S. PATENT DOCUMENTS

| | | | | |
|---|---|---|---|---|
| 891,383 | A | 6/1908 | Steinmetz | |
| 2,392,673 | A | 1/1946 | Kraft | |
| 2,795,373 | A * | 6/1957 | Hewson | 415/181 |
| 3,635,585 | A | 1/1972 | Metzler, Jr. | |
| 4,194,869 | A | 3/1980 | Corcokios | |
| 4,465,433 | A | 8/1984 | Bischoff | |
| 4,741,667 | A * | 5/1988 | Price et al. | 415/191 |
| 5,326,221 | A * | 7/1994 | Amyot et al. | 415/191 |
| 5,375,972 | A | 12/1994 | Gray | |
| 5,397,215 | A | 3/1995 | Spear et al. | |
| 5,466,123 | A | 11/1995 | Rose | |
| 5,581,996 | A | 12/1996 | Koch et al. | |
| 5,927,946 | A | 7/1999 | Lee | |
| 6,077,036 | A | 6/2000 | Heffron et al. | |
| 6,126,394 | A * | 10/2000 | Matsuda | 415/192 |
| 6,283,713 | B1 | 9/2001 | Harvey et al. | |
| 6,375,420 | B1 * | 4/2002 | Tanuma et al. | 415/199.5 |
| 6,561,761 | B1 | 5/2003 | Decker et al. | |
| 6,669,445 | B2 | 12/2003 | Staubach et al. | |
| 6,709,223 | B2 | 3/2004 | Walto et al. | |
| 6,709,233 | B2 * | 3/2004 | Haller | 415/192 |
| 6,779,973 | B2 | 8/2004 | Ito et al. | |
| 6,802,695 | B2 | 10/2004 | Haller | |

(Continued)

FOREIGN PATENT DOCUMENTS

| | | | |
|---|---|---|---|
| EP | 2138727 | A2 | 12/2009 |
| WO | 03052240 | A2 | 6/2003 |

OTHER PUBLICATIONS

Extended European Search Report cited in EP Application No. 12187836.7-1610, dated Mar. 4, 2013, pp. 1-7.

(Continued)

*Primary Examiner* — Igor Kershteyn
(74) *Attorney, Agent, or Firm* — Cantor Colburn LLP

(57) ABSTRACT

A turbine of a turbomachine is provided and includes opposing endwalls defining a pathway into which a fluid flow is receivable to flow through the pathway; and a nozzle stage at which adjacent nozzles extend across the pathway between the opposing endwalls to aerodynamically interact with the fluid flow. The adjacent nozzles are configured to define a throat distribution exhibiting endwall throat decambering and pitchline throat overcambering.

20 Claims, 3 Drawing Sheets

(56) References Cited

U.S. PATENT DOCUMENTS

| | | | | |
|---|---|---|---|---|
| 6,969,232 | B2 | 11/2005 | Zess et al. | |
| 7,044,710 | B2 | 5/2006 | Naik et al. | |
| 7,048,509 | B2 * | 5/2006 | Tominaga et al. | 416/223 A |
| 7,186,074 | B2 | 3/2007 | Blatchford et al. | |
| 7,390,171 | B2 | 6/2008 | Francini | |
| 7,520,728 | B2 | 4/2009 | Sleiman et al. | |
| 7,632,075 | B2 | 12/2009 | Liang et al. | |
| 7,740,449 | B1 | 6/2010 | Brown et al. | |
| 7,887,297 | B2 | 2/2011 | Alen-Bradley et al. | |
| 8,459,956 | B2 | 6/2013 | Pandey et al. | |
| 2006/0140768 | A1 | 6/2006 | Tam et al. | |
| 2006/0269399 | A1 | 11/2006 | Girgis et al. | |
| 2007/0224035 | A1 | 9/2007 | Nigmatulin | |
| 2007/0258818 | A1 | 11/2007 | Allen-Bradley et al. | |
| 2008/0050243 | A1 | 2/2008 | Liang | |
| 2008/0175714 | A1 | 7/2008 | Spangler et al. | |
| 2010/0074734 | A1 | 3/2010 | Little | |
| 2010/0158696 | A1 | 6/2010 | Pandey et al. | |
| 2010/0172749 | A1 | 7/2010 | Mitsuhashi et al. | |
| 2010/0254797 | A1 | 10/2010 | Grover et al. | |
| 2010/0284818 | A1 | 11/2010 | Sakamoto et al. | |
| 2011/0052387 | A1 | 3/2011 | Kneeland et al. | |
| 2011/0052413 | A1 | 3/2011 | Kwon et al. | |
| 2013/0017095 | A1 | 1/2013 | Lee et al. | |

OTHER PUBLICATIONS

Office Action issued in U.S. Appl. No. 13/284,010 dated Apr. 15, 2014, pp. 1-22.

Extended European Search Report for EP Application No. 12189881.1-1610, dated May 13, 2014, pp. 1-6.

Extended European Search Report for EP Application No. 12189836.5-1607, dated Jun. 20, 2013, pp. 1-6.

* cited by examiner

TURBINE OF A TURBOMACHINE

BACKGROUND OF THE INVENTION

The subject matter disclosed herein relates to a turbomachine and, more particularly, to a turbomachine having a throat distribution exhibiting endwall throat decambering and pitchline throat overcambering.

A turbomachine, such as a gas turbine engine, may include a compressor, a combustor and a turbine. The compressor compresses inlet gas and the combustor combusts the compressed inlet gas along with fuel to produce high temperature fluids. Those high temperature fluids are directed to the turbine where the energy of the high temperature fluids is converted into mechanical energy that can be used to generate power and/or electricity. The turbine is formed to define an annular pathway through which the high temperature fluids pass.

First stages of the turbine typically experience strong secondary flows in directions that are transverse to a main flow direction through the pathway. These secondary flows can negatively impact stage efficiencies.

BRIEF DESCRIPTION OF THE INVENTION

According to one aspect of the invention, a turbine of a turbomachine is provided and includes opposing endwalls defining a pathway into which a fluid flow is receivable to flow through the pathway; and a nozzle stage at which adjacent nozzles extend across the pathway between the opposing endwalls to aerodynamically interact with the fluid flow. The adjacent nozzles are configured to define a throat distribution exhibiting endwall throat decambering and pitchline throat overcambering.

According to another aspect of the invention, a turbomachine is provided and includes a compressor configured to compress inlet gas to produce compressed inlet gas, a combustor fluidly coupled to the compressor and configured to combust the compressed inlet gas along with fuel to produce a fluid flow and a turbine defining a pathway and being fluidly coupled to the combustor such that the fluid flow is receivable by the turbine to flow through the pathway. The turbine includes opposing endwalls and a nozzle stage at which adjacent nozzles extend across the pathway between the opposing endwalls to aerodynamically interact with the fluid flow and to define a throat distribution exhibiting endwall throat decambering and pitchline throat overcambering.

According to yet another aspect of the invention, a turbomachine is provided and includes a compressor configured to compress inlet gas to produce compressed inlet gas, a combustor fluidly coupled to the compressor and configured to combust the compressed inlet gas along with fuel to produce a fluid flow and a turbine defining a pathway and being fluidly coupled to the combustor such that the fluid flow is receivable by the turbine to flow through the pathway. The turbine includes opposing annular endwalls and a nozzle stage at which an annular array of nozzles extend across the pathway between the opposing endwalls to aerodynamically interact with the fluid flow such that any two adjacent nozzles of the annular array define a throat distribution exhibiting endwall throat decambering proximate to the endwalls and pitchline throat overcambering remote from the endwalls.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
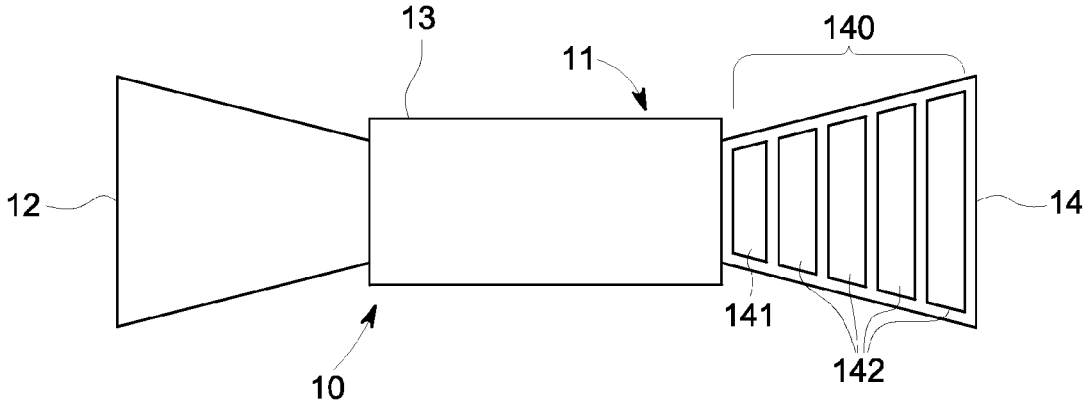
FIG. 1 is a schematic diagram of a gas turbine engine.
Figure 2:
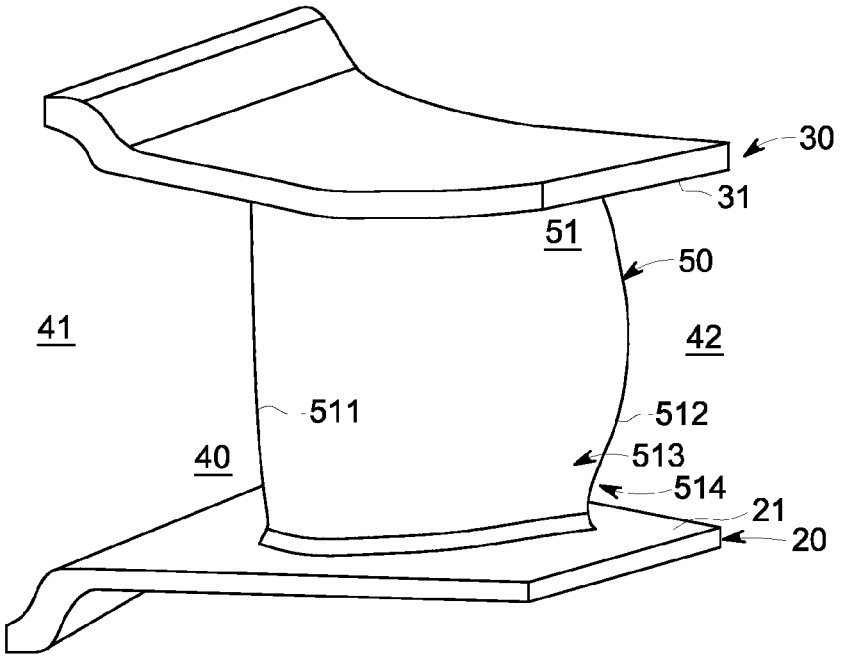
FIG. 2 is a perspective view of a nozzle of a first stage of a turbine of the gas turbine engine of FIG. 1.

The detailed description explains embodiments of the invention, together with advantages and features, by way of example with reference to the drawings.

DETAILED DESCRIPTION OF THE INVENTION

With reference to FIGS. 1-4 and, in accordance with aspects of the invention, a turbomachine 10 is provided as, for example, a gas turbine engine 11. As such, the turbomachine 10 may include a compressor 12, a combustor 13 and a turbine 14. The compressor 12 compresses inlet gas and the combustor 13 combusts the compressed inlet gas along with fuel to produce a fluid flow of, for example, high temperature fluids. Those exemplary high temperature fluids are directed to the turbine 14 where the energy of the high temperature fluids is converted into mechanical energy that can be used to generate power and/or electricity.

The turbine 14 includes a first annular endwall 20 and a second annular endwall 30, which is disposed about the first annular endwall 20 to define an annular pathway 40. The annular pathway 40 extends from an upstream section 41, which is proximate to the combustor 13, to a downstream section 42, which is remote from the combustor 13. The high temperature fluids are output from the combustor 13 and pass through the turbine 14 along the pathway 40 from the upstream section 41 to the downstream section 42. Each of the first and second endwalls 20 and 30 respectively includes a hot gas path facing surface 21 and 31 that facing inwardly toward the annular pathway 40.

The turbine 14 includes one or more axial stages 140 in which respective annular arrays of axially aligned nozzles and blades are provided. These axial stages 140 include a first axial stage 141 that is disposed at a forward portion of the turbine 14, downstream from an aft portion of the combustor 13 and upstream from subsequent axial stages 142.

The first axial stage 141 includes an annular array of first stage nozzles 50, which are provided such that each nozzle 50 is extendible across the pathway 40 from at least one or both of the first and second endwalls 20 and 30 to aerodynamically interact with the flow of the high temperature fluids. Each of the nozzles 50 may have an airfoil shape 51 with a leading edge 511 and a trailing edge 512 that opposes the leading edge 511, a pressure side 513 and a suction side 514. The pressure side 513 extends between the leading edge 511 and the trailing edge 512. The suction side 514 opposes the pressure side 513 and also extends between the leading edge 511 and the trailing edge 512. Each of the nozzles 50 at the first axial stage 141 may be disposed such that a pressure side 513 of any one of the nozzles 50 faces a suction side 514 of an adjacent one of the nozzles 50. With this configuration, as the high temperature fluids flow toward the pathway 40, the high temperature fluids aerodynamically interact with the nozzles 50 and are forced to flow with an angular momentum relative to a centerline of the turbine 14.

Figure 3:
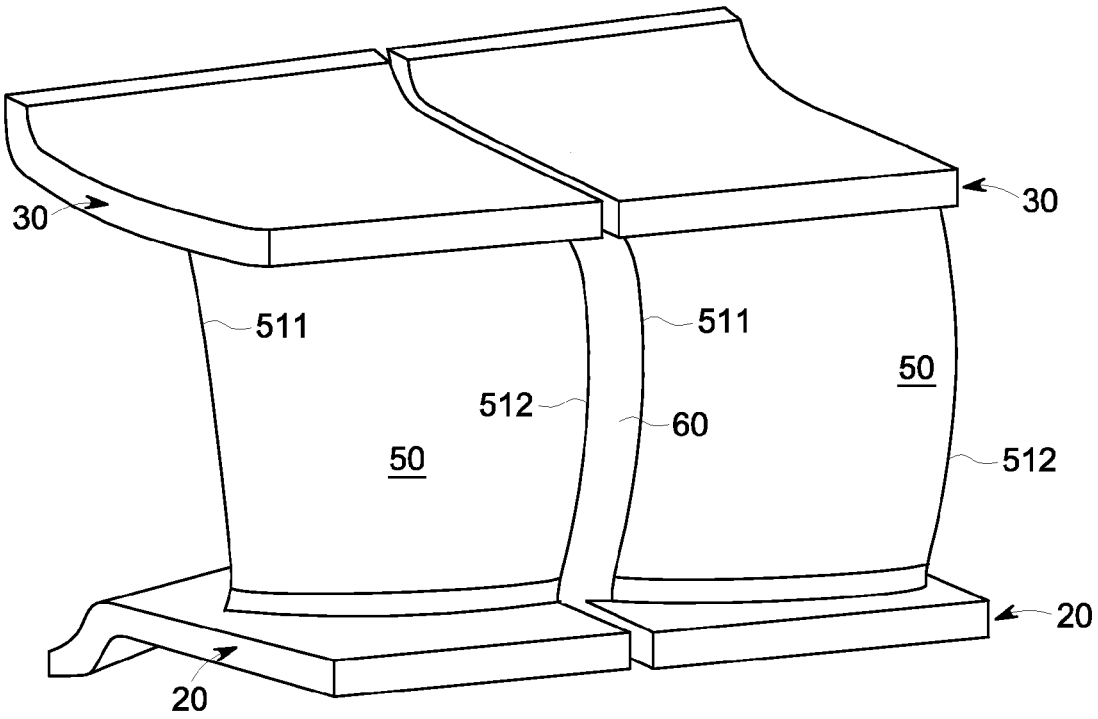
FIG. 3 is a perspective view of adjacent first stage nozzles at the first stage.
Figure 4:
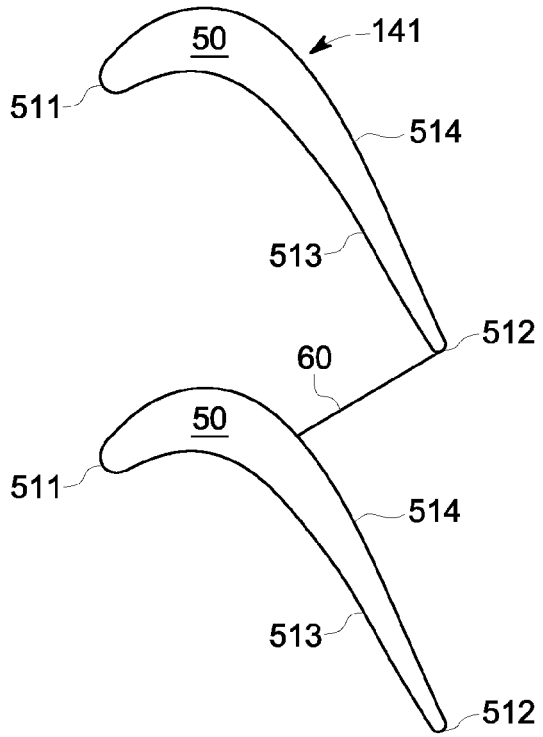
FIG. 4 is a schematic radial view of adjacent first stage nozzles at the first stage.

Normally, first turbine stages, such as the first axial stage 141, experience strong secondary flows in a direction transverse to a main flow direction through the pathway 40. These secondary flows can negatively impact stage efficiencies. In accordance with aspects, however, radial vortexing and stack distribution for the reduction of secondary flows is provided for the nozzles 50 of at least the first axial stage 141. As shown in FIGS. 3 and 4, any two adjacent nozzles 50 of the first axial stage 141 define a throat distribution 60 measured at a narrowest region of the pathway 40 between the adjacent nozzles 50 that exhibits endwall throat decambering radially proximate to the first and second endwalls 20 and 30 and pitchline throat overcambering radially remote from the first and second endwalls 20 and 30. That is, the nozzles 50 of at least the first axial stage 141 define a throat distribution 60 that exhibits endwall throat decambering at radial regions near the first and second endwalls 20 and 30. By contrast, the nozzles 50 of at least the first axial stage 141 define a throat distribution 60 that exhibits endwall throat overcambering at a radial region provided substantially centrally (i.e., along the pitchline) between the first and second endwalls 20 and 30

Figure 5:
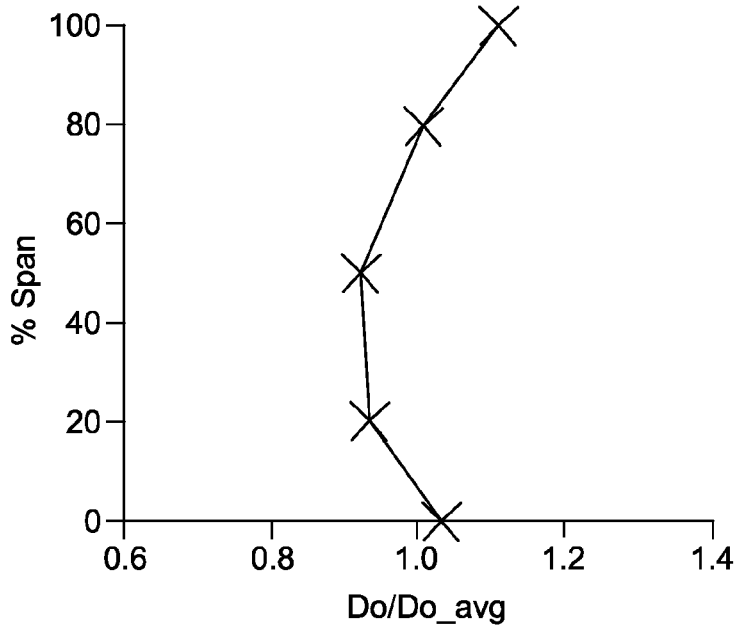
FIG. 5 is a graphical display of a non-dimensional throat distribution defined by the adjacent first stage nozzles.

With reference to FIG. 5, a non-dimensional expression of the throat distribution 60 is approximately:

$$y=-3^{-07}x^3+0.0001x^2-0.0067x+1.0299,$$

where y is the non-dimensional throat distribution and x is a span location between the opposing first and second endwalls 20 and 30 with 0% span representing the first endwall 20 and 100% span representing the second endwall 30. This equation and substantially similar equations can be solved for y to determine the non-dimensional throat distribution defined by the adjacent nozzles 50 at any span location (i.e., the 0% span location, the 20% span location, etc.).

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine of a turbomachine, comprising:

opposing endwalls defining a pathway into which a fluid flow is receivable to flow through the pathway; and a nozzle stage at which adjacent nozzles extend across the pathway between the opposing endwalls to aerodynamically interact with the fluid flow, the adjacent nozzles being configured to define a throat distribution exhibiting endwall throat decambering and pitchline throat overcambering.

2. The turbine according to claim 1, wherein the nozzle stage comprises a first nozzle stage disposed upstream from subsequent nozzle stages.

3. The turbine according to claim 1, wherein the opposing endwalls are annular.

4. The turbine according to claim 1, wherein the adjacent nozzles are disposed in an annular array.

5. The turbine according to claim 1, wherein the throat distribution is measured at a narrowest region of the pathway between the adjacent nozzles.

6. The turbine according to claim 1, wherein a non-dimensional expression of the throat distribution is approximately:

$$y=-3^{-07}x^3+0.0001x^2-0.0067x+1.0299,$$

where y is the non-dimensional throat distribution and x is a span location between the opposing endwalls.

7. A turbomachine, comprising:

a compressor configured to compress inlet gas to produce compressed inlet gas;

a combustor fluidly coupled to the compressor and configured to combust the compressed inlet gas along with fuel to produce a fluid flow; and a turbine defining a pathway and being fluidly coupled to the combustor such that the fluid flow is receivable by the turbine to flow through the pathway, the turbine including opposing endwalls and a nozzle stage at which adjacent nozzles extend across the pathway between the opposing endwalls to aerodynamically interact with the fluid flow and to define a throat distribution exhibiting endwall throat decambering and pitchline throat overcambering.

8. The turbomachine according to claim 7, wherein the nozzle stage is disposed at a forward portion of the turbine and downstream from an aft portion of the combustor.

9. The turbomachine according to claim 7, wherein the nozzle stage comprises a first nozzle stage disposed upstream from subsequent nozzle stages.

10. The turbomachine according to claim 7, wherein the opposing endwalls are annular.

11. The turbomachine according to claim 7, wherein the adjacent nozzles are disposed in an annular array.

12. The turbomachine according to claim 7, wherein the throat distribution is measured at a narrowest region of the pathway between the adjacent nozzles.

13. The turbomachine according to claim 7, wherein a non-dimensional expression of the throat distribution is approximately:

$$y=-3^{-07}x^3+0.0001x^2-0.0067x+1.0299,$$

where y is the non-dimensional throat distribution and x is a span location between the opposing endwalls.

14. A turbomachine, comprising:

a compressor configured to compress inlet gas to produce compressed inlet gas;

a combustor fluidly coupled to the compressor and configured to combust the compressed inlet gas along with fuel to produce a fluid flow; and a turbine defining a pathway and being fluidly coupled to the combustor such that the fluid flow is receivable by the turbine to flow through the pathway, the turbine including opposing annular endwalls and a nozzle stage at which an annular array of nozzles extend across the pathway between the opposing endwalls to aerodynamically interact with the fluid flow such that any two adjacent nozzles of the annular array define a throat distribution exhibiting endwall throat decambering proximate to the endwalls and pitchline throat overcambering remote from the endwalls.

15. The turbomachine according to claim 14, wherein the nozzle stage is disposed at a forward portion of the turbine and downstream from an aft portion of the combustor.

16. The turbomachine according to claim 14, wherein the nozzle stage comprises a first nozzle stage disposed upstream from subsequent nozzle stages.

17. The turbomachine according to claim 14, wherein the opposing endwalls are annular.

18. The turbomachine according to claim 14, wherein the adjacent nozzles are disposed in an annular array.

19. The turbomachine according to claim 14, wherein the throat distribution is measured at a narrowest region of the pathway between the adjacent nozzles.

20. The turbomachine according to claim 14, wherein a non-dimensional expression of the throat distribution is approximately:

$$y=-3^{-07}x^3+0.0001x^2-0.0067x+1.0299,$$

where y is the non-dimensional throat distribution and x is a span location between the opposing endwalls.

* * * * *